US005501656A

United States Patent [19]

Homma et al.

[11] Patent Number: 5,501,656

[45] Date of Patent: Mar. 26, 1996

[54] ARM MOTION SUPPORT APPARATUS

[75] Inventors: Keiko Homma; Tatsuo Arai, both of Tsukuba, Japan

[73] Assignees: Agency of Industrial Science & Technology; Ministry of International Trade & Industry, both of Tokyo, Japan

[21] Appl. No.: 296,470

[22] Filed: Aug. 26, 1994

[30] Foreign Application Priority Data

Aug. 26, 1993 [JP] Japan ..... 5-234131

[51] Int. Cl.[6] ..... A61H 1/00

[52] U.S. Cl. ..... 601/33; 602/36; 606/241

[58] Field of Search ..... 602/32–36; 482/69, 482/904; 606/241; 5/81.1, 85.1, 623, 646, 647; 601/33, 40, 34

[56] References Cited

U.S. PATENT DOCUMENTS

| | | | |
|---|---|---|---|
| 2,274,574 | 2/1942 | Zerne | 601/34 |
| 2,631,582 | 3/1953 | Bensfield | 601/33 |
| 3,583,398 | 6/1971 | Bailey, II | 602/33 |
| 4,483,330 | 11/1984 | Jacobsen et al. | 602/32 |
| 5,048,825 | 9/1991 | Kelly | 482/904 |
| 5,290,219 | 3/1994 | Hetrick | 602/32 |
| 5,333,333 | 8/1994 | Mah | 5/81.1 |

FOREIGN PATENT DOCUMENTS

| | | | |
|---|---|---|---|
| 0281822 | 9/1988 | European Pat. Off. . | |
| 0610517 | 8/1994 | European Pat. Off. . | |
| 1509068 | 9/1989 | U.S.S.R. | 602/32 |
| WO94/00577 | 1/1994 | WIPO . | |

*Primary Examiner*—Richard J. Apley
*Assistant Examiner*—Jeanne M. Clark
*Attorney, Agent, or Firm*—Oblon, Spivak, McClelland, Maier & Neustadt

[57] ABSTRACT

An apparatus for supporting arm movement is provided that is structurally light and simple, does not cause patients to feel restrained, is capable of controlling arm movements with a large degree of freedom and can effectively help patients to make everyday arm movements under their own volition, and to perform functional exercises.

6 Claims, 3 Drawing Sheets

ARM MOTION SUPPORT APPARATUS

BACKGROUND OF THE INVENTION

1. Field of the Invention

This invention relates to an arm motion support apparatus that helps persons having arm related motor function disabilities to perform volitional arm movements and functional exercises.

2. Description of the Prior Art

Devices that have been proposed or are commercially available for supporting arm movement by persons having disabilities related to the motor functions of the arms include non-motorized arm suspension devices which employ springs, powered devices that use lines (cords or wires) or the like to move an arm up and down, and crane arrangements with seven degrees of freedom that use horizontal manipulators and lines for vertical movement.

However, the drawback of these conventional apparatuses is that they do not provide a large degree of control of arm movement, using a simple apparatus and simple control. Apparatuses that are simple do not provide satisfactory control of movement, while those that do provided satisfactory control are highly complex.

Also, with respect to powered devices for aiding autonomous arm movement and functional exercises, when a mechanically driven manipulator is fastened to a patient's arm, the patient has the unpleasant feeling of being restrained by a machine. Thus, there is a need for an apparatus that eliminates such unpleasant feelings and is at the same time lighter, and in which full regard is given to considerations of safety when mistakes are made in movements.

An object of the present invention is to provide an apparatus for supporting arm movement that is structurally light and simple, does not cause patients to feel restrained, can control arm movements with a large degree of freedom and can effectively help patients to make everyday arm movements under their own volition, and to perform functional exercises.

SUMMARY OF THE INVENTION

In accordance with this invention, the above object is attained by an arm motion support apparatus comprising:

- a first orthesis fitted to the elbow region of the arm,
- a second orthesis fitted to the wrist region,
- a first group of lines connected at one end to the first orthesis,
- a second group of lines connected at one end to the second orthesis,
- a support member that is located above the arm and has a plurality of guide elements that maintain each of the lines of the first and second groups away from the other lines, and
- winder means that is connected to the other ends of the lines to control lead-out lengths of lines.

The above arm motion support apparatus provides effective support for a patient who wishes to perform everyday movements or functional exercises under his or her own volition, by controlling the lead-out length of each of the lines along a target path of arm motion determined according to the content of the desired motion or exercise, thereby effecting multiple degree of freedom positioning of the elbow and wrist. This multiple degree of freedom positioning is realized using a light and simple arrangement in which supporting lines are used to raise and lower the arm, and in which control is simple, involving only control of the lengths of the lines. Moreover, this procedure does not cause patients to feel that they are being restrained by the apparatus.

Further features of the invention, its nature and various advantages will be more apparent from the accompanying drawings and following detailed description of the invention.

DESCRIPTION OF THE PREFERRED EMBODIMENTS

Figure 1:
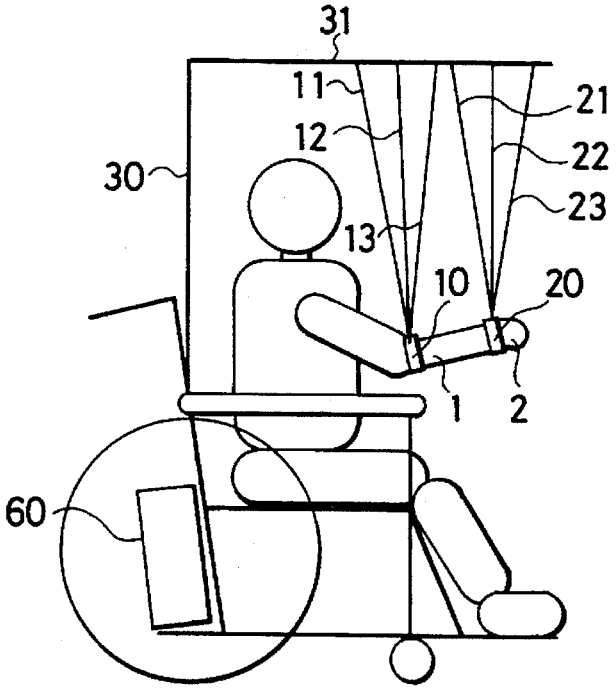
FIG. 1 is a schematic side view showing a wheelchair equipped with the arm motion support apparatus of the present invention.
Figure 2:
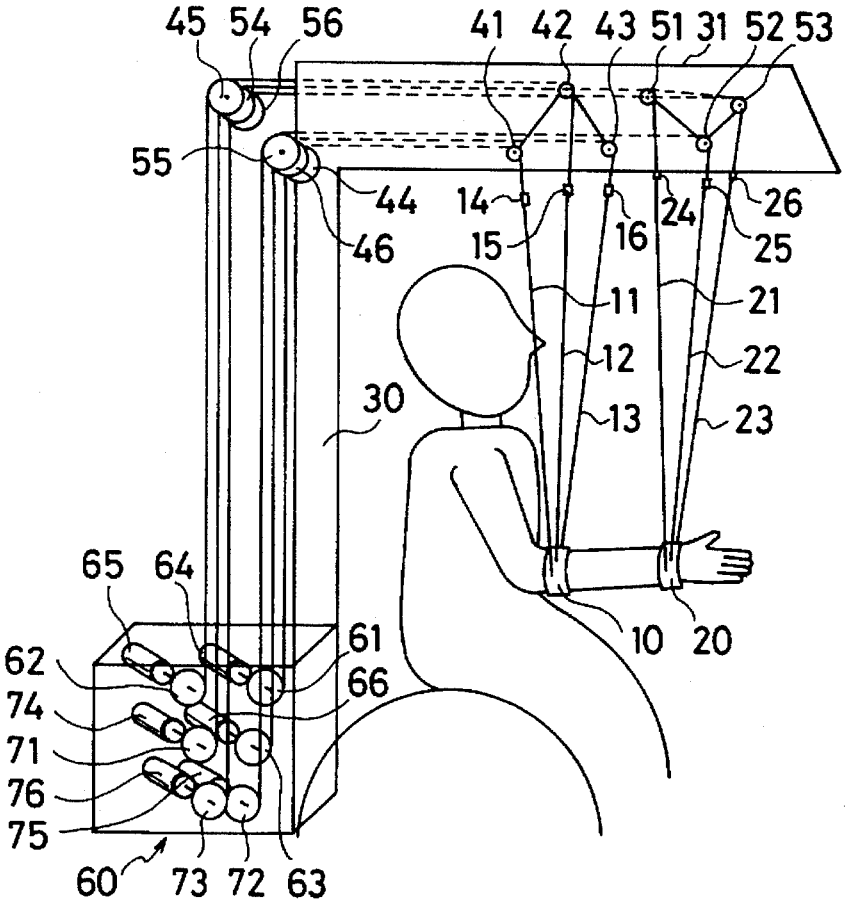
FIG. 2 is an explanatory view showing the arm motion support apparatus of FIG. 1.

FIGS. 1 and 2 show an arrangement in which a wheelchair has been equipped with the arm motion support apparatus of this invention. The arm motion support apparatus is provided with ortheses 10 and 20 which are fitted to a patient's elbow 1 and wrist 2, respectively, multiple lines 11, 12 and 13 and 21, 22 and 23 from which the ortheses 10 and 20 depend, an upright 30 which supports a support member 31 that is positioned above the patient's range of arm movement, and a motorized winder 60 that controls the lead-out lengths of lines 11 to 13 and 21 to 23.

The ortheses 10 and 20 are in the form of straps that are spaced apart and wrapped around the elbow 1 and wrist 2 regions respectively, and are each suspended from the support member 31 by at least three lines, lines 11 to 13 in the case of orthesis 10 and lines 21 to 23 in the case of orthesis 20. Lines 11 to 13 and 21 to 23 are attached to their respective ortheses 10 and 20 at spaced points around the arm. As described below, this makes it possible to effect three-dimensional positioning of the ortheses by regulating the length of each line, while the posture of an arm can be controlled by the relative position between the two ortheses and an arm twist degree of freedom can be controlled by separating the positions of connection between the lines above the ortheses. Lines 11 to 13 and 21 to 23 can be attached to one point on their respective ortheses 10 and 20, but this will result in a loss of the ability to twist the arm.

The lines 11 to 13 and 21 to 23 are passed around corresponding guide elements 41, 42 and 43 and 51, 52 and 53 disposed on the support member 31 in a mutually spaced-apart relationship. The guide elements 41 to 43 and 51 to 53 keep the lines parallel and separate. The other ends of the lines are passed around guide elements 44 and 54 at the top of the upright 30, and are connected to winches 61, 62 and 63 and 71, 72 and 73, respectively, in the winder 60. The guide elements may be pulleys, for example.

The winder 60 includes the winches 61 to 63 and 71 to 73, motors 64, 65 and 66 and 74, 75 and 76 used to drive the winches, a control unit (not shown) for controlling the operation of the motors, and a power supply. The winder 60 uses sensors to determine the lead-out lengths of the lines based on the angles of rotation of the motors 64 to 66 and 74 to 76. To ensure safety in the event of movement errors, the lines are provided with mechanical stops 14, 15 and 16 and 24, 25 and 26. These stops prevent excessive take-up of lines, as once a stop abuts against the top of the apparatus, the line concerned cannot be retracted any further.

Operating commands to the control unit of the winder 60 vary according to how the arm motion support apparatus is being used. It can be operated by switch by the patient himself, for example, or by voice or myoelectric potential, or it can be operated by switch by a physician or physiotherapist. The upright 30 of the above arm motion support apparatus can thus be installed on a wheelchair, or by a bed, or at any place where a person who has an arm-related functional disability wishes to move his or her arm autonomously or perform functional exercises, with the winder 60 being provided at the base of the upright 30.

In the arm motion support apparatus thus configured the target arm path, which is to say the paths of the ortheses 10 and 20, is determined according to the content of the desired motion or exercise. In the case of exercise of the arm, the required motion commands are given to the control unit, and the control unit sets the target values for the lengths of each of the lines 11 to 13 and 21 to 23, and uses its sensors to monitor the lead-out lengths of the lines as it individually controls the amount of rotation of each of the motors 64 to 66 and 74 to 76, in this way controlling the lead-out lengths to thereby thereby effecting multiple degree of freedom positioning of the ortheses 10 and 20. Each of the lines is normally maintained under a slight tension by the winches.

Using the arrangement shown by FIG. 2 in which the forearm is suspended by lines descending from the support member 31, three lines to the elbow 1 region and three lines to the wrist 2 region, the arm motion support apparatus will now be explained with reference to FIGS. 3, 4 and 5. The range of forearm movement differs according to the positional arrangement of the lines descending from the support member 31. The arrangement described here with reference to the drawings is just one example, and is not to be taken as indicating that this is a line lead-out arrangement for general use. During fabrication of the arm motion support apparatus, a range of forearm movement has to be set by selecting line lead-out positions on the support member 31 that correspond to what the apparatus is actually going to be used for.

Figure 3:
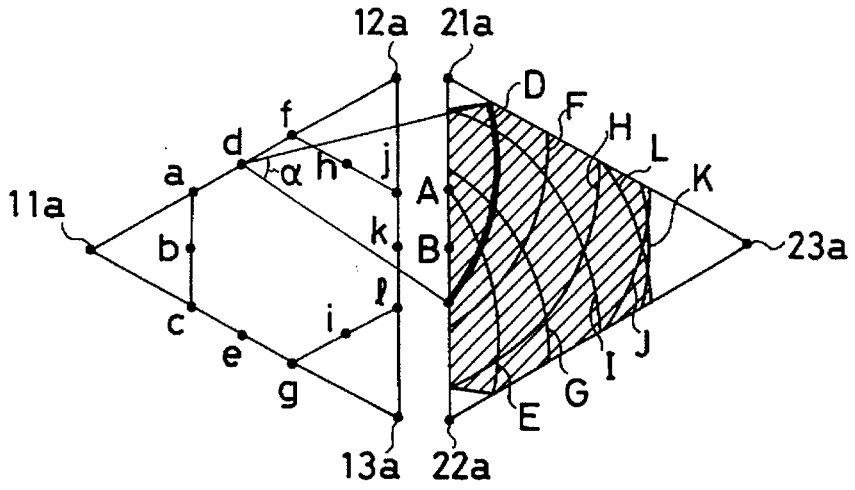
FIG. 3 is a plan view illustrating the range of elbow and wrist movement in the case of one example of a line lead-out arrangement.
Figure 4:
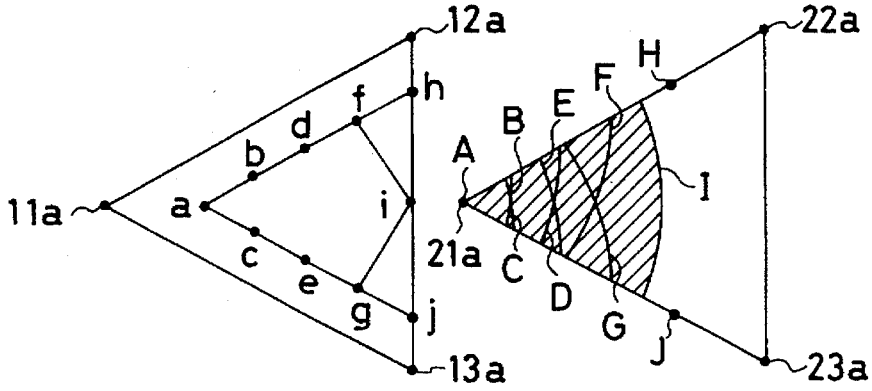
FIG. 4 is a plan view of another line lead-out arrangement.
Figure 5:
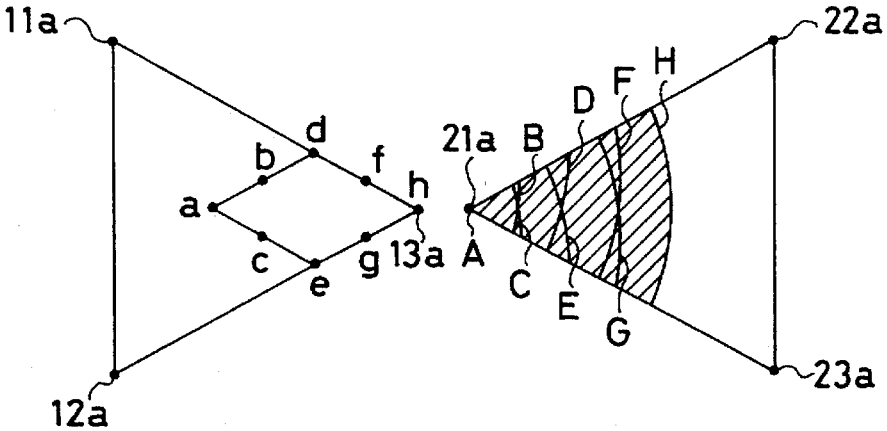
FIG. 5 is a plan view of a further line lead-out arrangement.

FIGS. 3, 4 and 5 depict the range of movement of elbow and wrist when the forearm is horizontal and the resultant force of the line tensions has no axial component. In the drawings, lead-out positions of lines 11 to 13 and 21 to 23 on the support member 31 are indicated by reference numerals 11*a*, 12*a* and 13*a* and 21*a*, 22*a* and 23*a*. The shaded portions show the range of possible wrist movement when it is assumed that one side of each of the triangles formed by connecting the elbow and the wrist line lead-out positions is $20\sqrt{3}$ cm, the two triangles are 5 cm apart, the distance from the forearm to where the lines emerge on the support member 31 is 100 cm and the length of the forearm is 25 cm.

Figure 6:
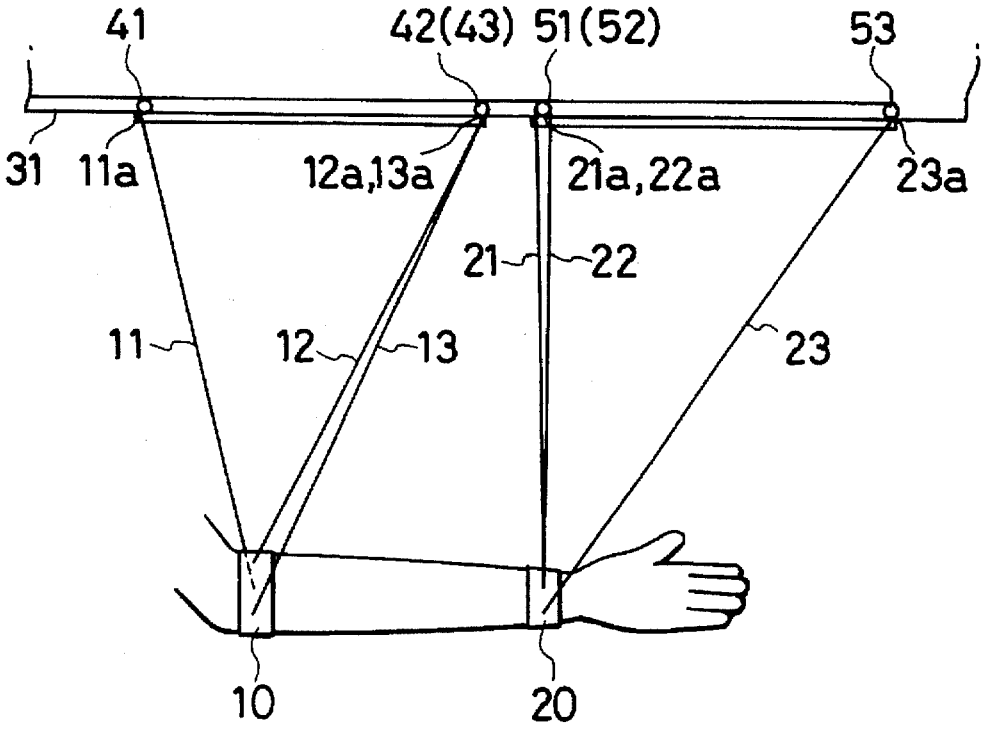
FIG. 6 illustrates how the lines are connected to the ortheses in the case of the line lead-out arrangement of FIG. 3.

FIG. 6 illustrates the relationship between the connections of lines 11 to 13 and 21 to 23 to the ortheses 10 and 20 when the line lead-out positions 11*a* to 13*a* and 21*a* to 23*a* of FIG. 3 are used. The curved lines "A" to "L" in FIGS. 3 to 5 represent paths of wrist movement capability when the elbow is at positions "a" to "1". That is, when an attempt is made to move the wrist when the elbow orthesis 10 of FIG. 6 is at point "a" of FIG. 3 and the wrist orthesis 20 is suspended from point "A", at least one line will have zero or negative tension, so that no movement can take place. When the elbow is at point "d", the wrist will be at point "D" and the path of movement will be "D". Movement will be possible within the range of angle α. Thus, the broadest range of elbow and wrist movement is achieved when the line lead-out positions of FIG. 3 are used.

As has been described in the foregoing, in accordance with the present invention in which the arm is positioned by using ortheses suspended from lines and controlling the length of the lines, with the lines arranged in parallel, there is a physical limitation to the range of possible movement, so safety is enhanced with respect to movement errors. In addition, safety is ensured by the provision of mechanical stops on the lines which prevents lines from being excessively shortened.

Moreover, attaching a manipulator to a patient's arm causes the patient to feel unpleasantly restrained by a machine. However, in the case of this invention this type of uneasy feeling on the part of patients is eliminated by the use of lines to suspend the arm, and using such lines also helps to reduce the weight of the apparatus.

Thus, the arm motion support apparatus of the invention configured as described in the foregoing is structurally light and simple, with the arm being moved up and down suspended by lines, and control is also simple, being just a matter of controlling the length of the lines. The result is an apparatus that enables arm movement to be controlled with a large degree of freedom without causing the patient to feel unpleasantly restrained, and which can effectively help patients to make ordinary, everyday arm movements under their own volition, and perform functional exercises.

What is claimed is:

1. An arm passive motion apparatus comprising:

a first orthesis having a sufficient length to surround the arm of the user approximately about the elbow region and a first securing means to fasten the first orthesis about the arm;

a second orthesis having a sufficient length to surround the arm of the user approximately about the wrist region and a second securing means to fasten the second orthesis about the arm;

a first group of lines connected at their first end to the first orthesis wherein each line of the first group is connected in a spaced relationship about the circumference of the orthesis and the arm in order to provide multiple directional positioning of the arm;

a second group of lines connected at their first end to the second orthesis wherein each line of the second group is connected in a spaced relationship about the circumference of the orthesis and the arm in order to provide multiple directional positioning of the arm;

a support member fixed to a supporting means for locating the support member about the user and his arms, said support member including a plurality of guide members wherein each line is supported by at least one of the guide members such that all the lines are kept separated; and winder means for individually controlling the length of each of the lines, said winder means being directly connected to the second ends of each of the first and second groups of lines and the winder means controlling the position of the arm in multiple degrees of freedom by selectively lengthening and shortening each line to achieve the desired position.

2. An apparatus according to claim 1, wherein the first and second ortheses comprise straps.

3. An apparatus according to claim 1, wherein the first and second groups of lines each comprise three lines.

4. An arm passive motion apparatus comprising:

a first orthesis having a sufficient length to surround the arm of the user approximately about the elbow region and a first securing mechanism fastening the first orthesis about the arm;

a second orthesis having a sufficient length to surround the arm of the user approximately about the wrist region and a second mechanism fastening the second orthesis about the arm;

a first group of lines connected at their first end to the first orthesis wherein each line of the first group is connected in a spaced relationship about the circumference of the orthesis and the arm in order to provide multiple directional positioning of the arm;

a second group of lines connected at their first end to the second orthesis wherein each line of the second group is connected in a spaced relationship about the circumference of the orthesis and the arm in order to provide multiple directional positioning of the arm;

a support member fixed to a fixed support located near the user for locating the support member above the user and its arms, said support member including a plurality of guide members wherein each line is supported by at least one of the guide members such that all the lines are kept separated; and a winder including a mechanism for individually winding the lines and a control unit for individually controlling the length of each of the lines, wherein said winder is directly connected to the second ends of each of the first and second groups of lines and wherein the winder controls the position of the arm in multiple degrees of freedom by selectively lengthening and shortening each line to achieve the desired position.

5. An apparatus according to claim 4, wherein the first and second orthesis comprise straps fastened around the arm.

6. An apparatus according to claim 4, wherein the first and second groups of lines each comprise three lines.

* * * * *

UNITED STATES PATENT AND TRADEMARK OFFICE

CERTIFICATE OF CORRECTION

PATENT NO. : 5,501,656

DATED : March 26, 1996

INVENTOR(S) : Keiko HOMMA et al.

It is certified that error appears in the above-indentified patent and that said Letters Patent is hereby corrected as shown below:

On the title page, Item [73], the Assignee is written incorrectly. It should read:

--[73] Assignee: Agency of Industrial Science & Technology, Ministry of International Trade & Industry, Tokyo, Japan--

Signed and Sealed this

Eighteenth Day of June, 1996

*Attest:*

*Attesting Officer*

BRUCE LEHMAN

*Commissioner of Patents and Trademarks*